US009236677B2

(12) United States Patent
Cole et al.

(10) Patent No.: US 9,236,677 B2
(45) Date of Patent: Jan. 12, 2016

(54) SPRING POWER CONTACT HAVING NON-LINEAR SLOT

(71) Applicant: XEROX CORPORATION, Norwalk, CT (US)

(72) Inventors: David R. Cole, Biggleswade (GB); Allan D. McIver, Stevenage (GB); Ian Burdon, Letchworth (GB); Christopher N. Hancox, Huntingdon (GB)

(73) Assignee: Xerox Corporation, Norwalk, CT (US)

( * ) Notice: Subject to any disclaimer, the term of this patent is extended or adjusted under 35 U.S.C. 154(b) by 23 days.

(21) Appl. No.: 14/248,467

(22) Filed: Apr. 9, 2014

(65) Prior Publication Data

US 2015/0295336 A1 Oct. 15, 2015

(51) Int. Cl.

| | |
|---|---|
| ***H01R 4/48*** | (2006.01) |
| ***H01R 13/24*** | (2006.01) |
| ***H01R 12/71*** | (2011.01) |

(52) U.S. Cl.

CPC ..... *H01R 13/24* (2013.01); *H01R 12/71* (2013.01)

(58) Field of Classification Search

CPC ..... H01R 13/24
USPC ..... 439/81, 862
See application file for complete search history.

(56) References Cited

U.S. PATENT DOCUMENTS

| | | | | |
|---|---|---|---|---|
| 2,800,635 | A | 7/1957 | Christenbery | |
| 4,443,050 | A | 4/1984 | Taylor | |
| 4,484,381 | A | 11/1984 | Ellis et al. | |
| 4,662,706 | A | 5/1987 | Foley | |
| 5,152,695 | A * | 10/1992 | Grabbe et al. | 439/71 |
| 5,917,147 | A | 6/1999 | Lewis | |
| 6,062,919 | A | 5/2000 | Trafton | |
| 6,299,999 | B1 | 10/2001 | Buchner et al. | |
| 6,315,621 | B1 * | 11/2001 | Natori et al. | 439/862 |
| 6,409,523 | B1 | 6/2002 | Shih | |
| 6,685,512 | B2 * | 2/2004 | Ooya | 439/630 |
| 6,776,635 | B2 | 8/2004 | Blanchfield et al. | |
| 7,247,035 | B2 | 7/2007 | Mok et al. | |
| 7,559,811 | B1 * | 7/2009 | Polnyi | 439/862 |
| 8,465,008 | B2 | 6/2013 | Beer et al. | |
| 9,033,750 | B2 * | 5/2015 | Miller et al. | 439/862 |

FOREIGN PATENT DOCUMENTS

| | | |
|---|---|---|
| WO | 83/00777 | 3/1983 |
| WO | 96/19854 | 6/1996 |

OTHER PUBLICATIONS

Yan Qiao et al., "Metal-driven hierarchical self-assembled zigzag nanoarchitectures with electrical conductivity", Chem Comm Communication, vol. 49, pp. 704-706.

* cited by examiner

*Primary Examiner* — Tho D Ta
(74) *Attorney, Agent, or Firm* — Gibb & Riley, LLC

(57) ABSTRACT

A power supply apparatus receives a voltage from power rails on a circuit board. The power supply apparatus comprises a frame and arms connected to the frame. Each of the arms comprises a contact end. The frame positions the contact end of each of the arms to contact the power rails of the circuit board. The contact end is biased towards the power rails to maintain the contact end in contact with the power rails. The contact end comprises a curved planar surface having a first edge and a second edge that terminates at an end edge. The first edge and the second edge follow a curved line, while the end edge follows a straight line. The contact end comprises a non-linear slot extending from the end edge along the curved planar surface and is positioned equally between the first edge and the second edge.

17 Claims, 6 Drawing Sheets

SPRING POWER CONTACT HAVING NON-LINEAR SLOT

BACKGROUND

Devices herein generally relate to power contacts and more particularly to spring power contacts having non-linear slots.

Conductive spring contacts are commonly used to make electrical contact with corresponding contacts on circuit boards. For example, to ensure good electrical contact between high voltage power board pick up wires and a power track, a spring steel curved strip is used. This strip can be slotted at the contact end to allow independent spring motion to be applied to each of the contact wires on the board, but with such, the high voltage board and power contact pickups are closely constrained to each other to ensure that there is always good point contact between the two corresponding contact wires on the circuit board and the two portions of slotted steel strip. However, a small variation on the high voltage board insertion into its rest position can cause the power tracts to kick over and one of the contact wires on the board can be positioned in the steel contact slot leading to only one point of contact instead of the desired two points of contact.

SUMMARY

A power supply apparatus is disclosed that receives a voltage from power rails on a circuit board. The power supply apparatus comprises a frame and arms connected to the frame. Each of the arms comprises a contact end. The frame positions the contact end of each of the arms to contact the power rails of the circuit board. The contact end is biased towards the power rails (and toward the circuit board) to maintain the contact ends in contact with the power rails. The contact end comprises a curved planar surface having left and right edges (e.g., a "first" edge and a "second" edge) that terminates at the end of the curved planar surface (e.g., an "end" edge).

More specifically, the first edge and the second edge follow a curved line, while the end edge follows a straight line. The first edge and the second edge extend along parallel curved lines within the curved planar surface and define the width dimension of the contact end, while the length dimension of the contact end runs from the arm to the end edge. The arm and the contact end can be a continuous, unbroken element, or can be separate elements connected to one another. Further, the arm and the contact end are electrical conductors and can comprise, for example a metal, an alloy, etc.

The contact end has a non-linear slot extending from the end edge along the curved planar surface that is positioned equally between the first edge and the second edge. The contact end is a voltage contact, and the non-linear slot equally splits the voltage contact into multiple voltage contacts. The non-linear slot has a regular waveform shape, such as a zigzag shape, sine wave shape, W-shape, Z-shape, S-shape, etc., all of which are simply referred to as a zigzag shape for ease of nomenclature.

More specifically, the zigzag shaped slot has at least one first portion extending along a first line that is at a first angle (that is other than parallel to the first edge and the second edge within the curved planar surface) and at least one second portion extending along a different second line that is at a second angle (that is also other than parallel to the first edge and the second edge within the curved planar surface) where the first angle is complementary with the second angle (relative to the first edge and the second edge within the curved planar surface). For example, if the first angle is +30° from being parallel to the first and second edges, the second angle can be −30° from being parallel to the first and second edges to from complementary angled lines. Further, the non-linear slot comprises a consistently dimensioned space centered between the first edge and the second edge.

These and other features are described in, or are apparent from, the following detailed description.

BRIEF DESCRIPTION OF THE DRAWINGS

Various exemplary devices are described in detail below, with reference to the attached drawing figures, in which.

DETAILED DESCRIPTION

Figure 1:
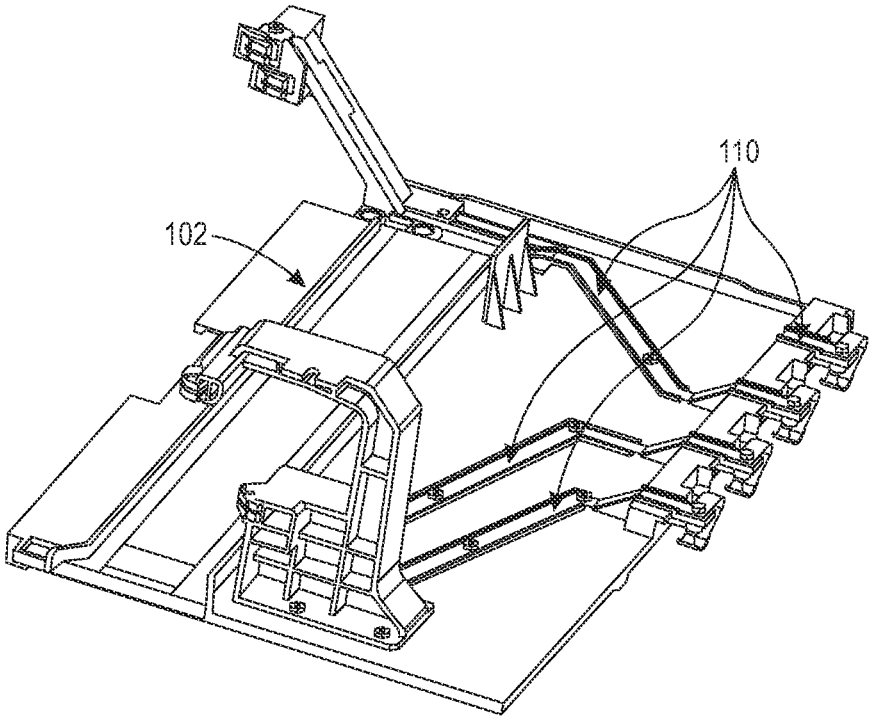
FIG. 1 is a schematic perspective diagram of a frame and arms herein.
Figure 2:
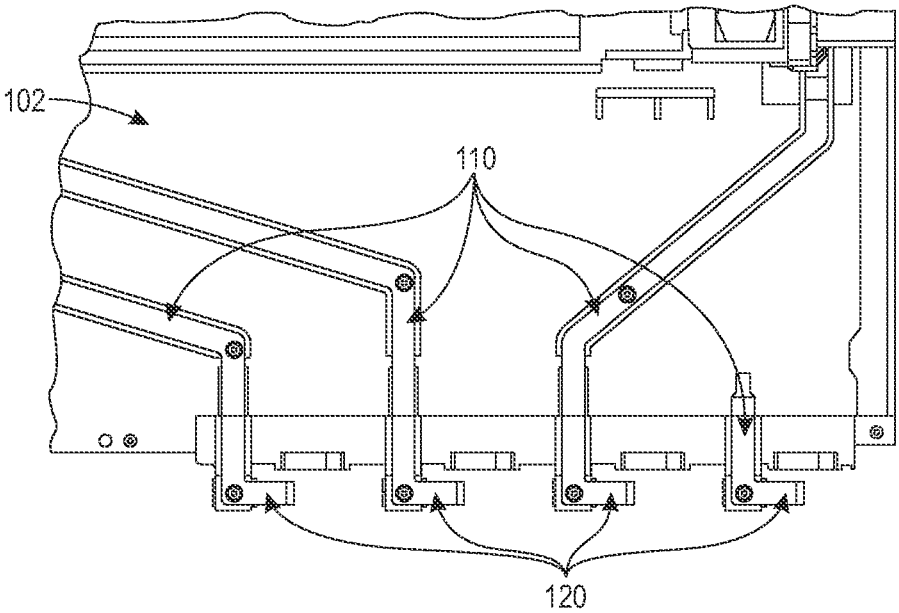
FIG. 2 is a schematic plan view diagram of a frame and arms herein.
Figure 3:
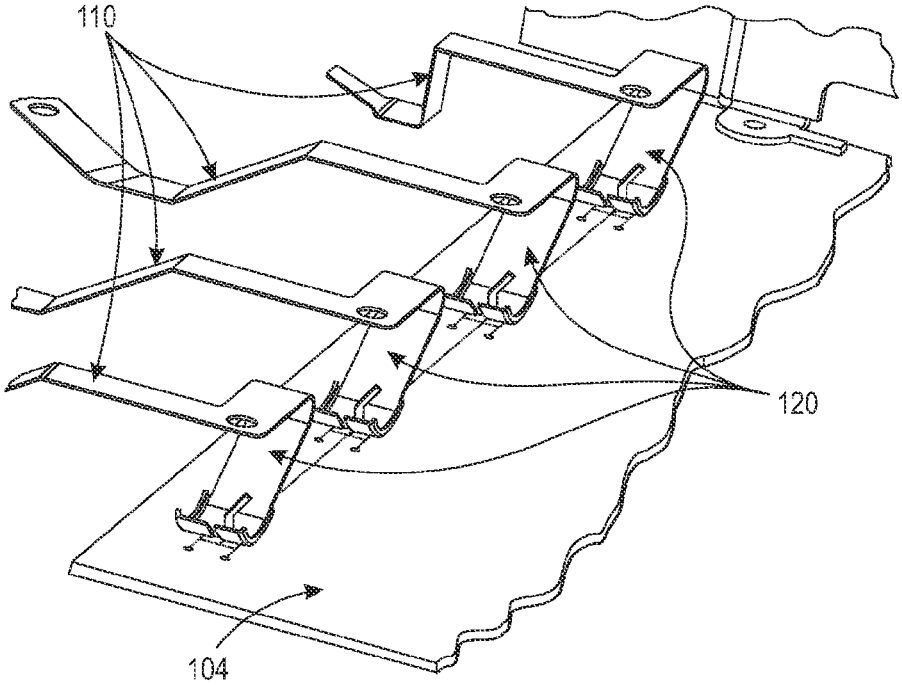
FIG. 3 is a schematic perspective diagram of arms and contact ends herein.
Figure 4:
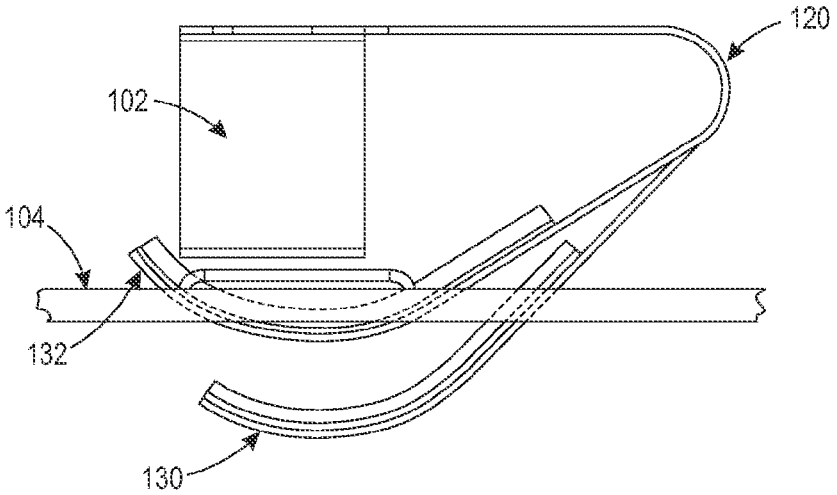
FIG. 4 is a schematic side view diagram of contact ends herein.

As mentioned above, a small variation on the high voltage board insertion into its rest position can cause the power tracts to kick over and one of the contact wires on the board can be positioned in the steel contact slot leading to only one point of contact instead of the desired two points of contact. Therefore, the devices herein provide a "zigzag" style slot to ensure that two-point contact is guaranteed as the two sprung steel contacts on the power track are still separate, but the contact wire on the high voltage board cannot fall between them.

Without a zigzag style slot, the sprung steel contact can flex when the high voltage board is inserted into the device, which can cause the contact to kick over, leading to positioning the slot over one of the wires on the high voltage board. When one of the contact wires becomes positioned in the slot of the spring contact, this prevents sufficient contact to meet performance standards. However, the zigzag slot presented herein prevents a contact wire from entering the slot.

FIGS. 1-5 illustrate a power supply apparatus that receives a voltage from power rails 106 on a circuit board 104. The power supply apparatus comprises a frame 102 and arms 110 connected to the frame 102. Each of the arms 110 comprises a contact end 120 that receives power (e.g., voltage, current, etc.) from the circuit board 104 and supplies such power to other elements that are connected to the frame 102. The frame 102 positions the contact end 120 of each of the arms 110 to contact the power rails 106 of the circuit board 104. The two portions of the contact end 120 that are separated by the non-linear slot 122 are independently sprung (e.g., biased) towards the power rails 106 (and toward the circuit board 104) to maintain the portions of the contact ends 120 in contact with the power rails 106. The contact end 120 comprises a curved planar surface having left and right edges (e.g., a "first" edge and a "second" edge) that terminate at the end of the curved planar surface (e.g., an "end" edge).

Figure 5:
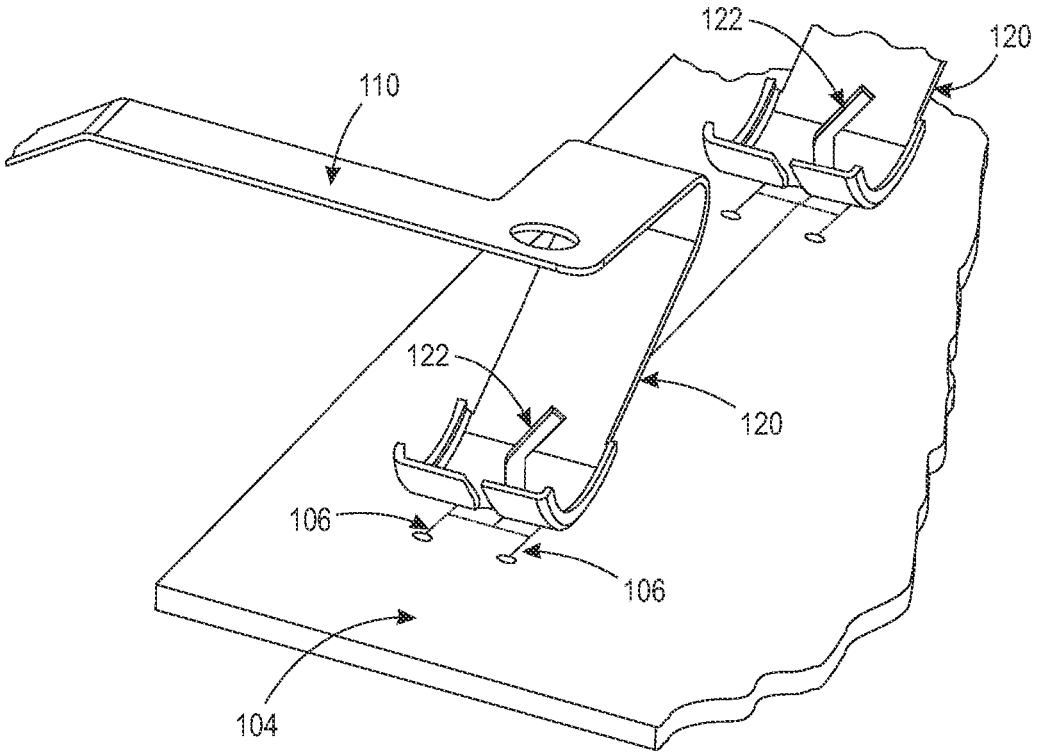
FIG. 5 is a schematic perspective view diagram of contact ends herein.
Figure 6:
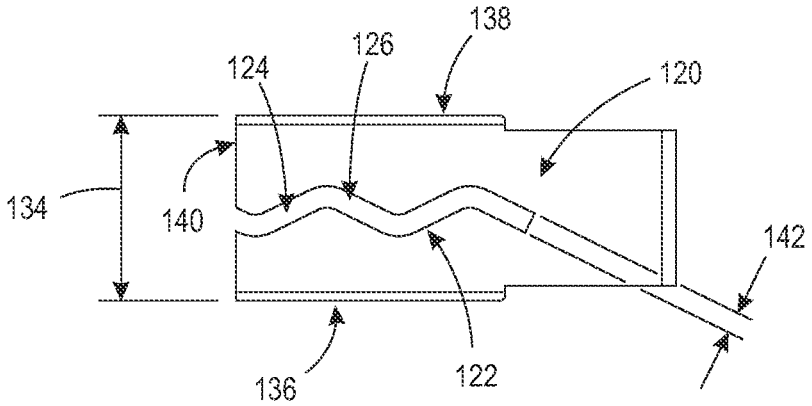
FIG. 6 is a schematic plan view diagram of contact ends herein.

More specifically, as shown in FIGS. 5 and 6 for example, the first edge 136 and the second edge 138 follow a curved line, while the end edge 140 follows a straight line. The first edge 136 and the second edge 138 extend along parallel curved lines within the curved planar surface and define the width dimension 134 of the contact end 120, while the length dimension of the contact end 120 runs from the arm 110 to the end edge 140. The arm 110 and the contact end 120 can be a continuous, unbroken element, or can be separate elements connected to one another. Further, the arm 110 and the contact end 120 are electrical conductors and can comprise, for example a metal, an alloy, etc.

The contact end 120 has a non-linear slot extending from the end edge 140 along the curved planar surface that is positioned equally between the first edge 136 and the second edge 138. The contact end 120 is a voltage contact, and the non-linear slot equally splits the voltage contact into multiple voltage contacts that are independently biased toward the board wires 106. The non-linear slot has a regular waveform shape, such as a zigzag shape, sine wave shape, W-shape, Z-shape, S-shape, etc., all of which are simply referred to as a zigzag shape for ease of nomenclature and are intended to be illustrated by item 122 in the drawings as such would be understood by those ordinarily skilled in the art.

More specifically, as shown in FIG. 6, the zigzag shaped slot 122 has at least one first portion 124 extending along a first line that is at a first angle (that is other than parallel to the first edge 136 and the second edge 138 within the curved planar surface) and at least one second portion 126 extending along a different second line that is at a second angle (that is also other than parallel to the first edge 136 and the second edge 138 within the curved planar surface) where the first angle is complementary with the second angle (relative to the first edge 136 and the second edge 138 within the curved planar surface). For example, if the first angle is +30° from being parallel to the first and second edges 136, 138, the second angle is −30° from being parallel to the first and second edges 136, 138 to form complementary angled lines relative to the first and second edges 136, 138. Further, the non-linear slot 122 comprises a consistently dimensioned space 142 centered between the first edge 136 and the second edge 138.

Figure 7:
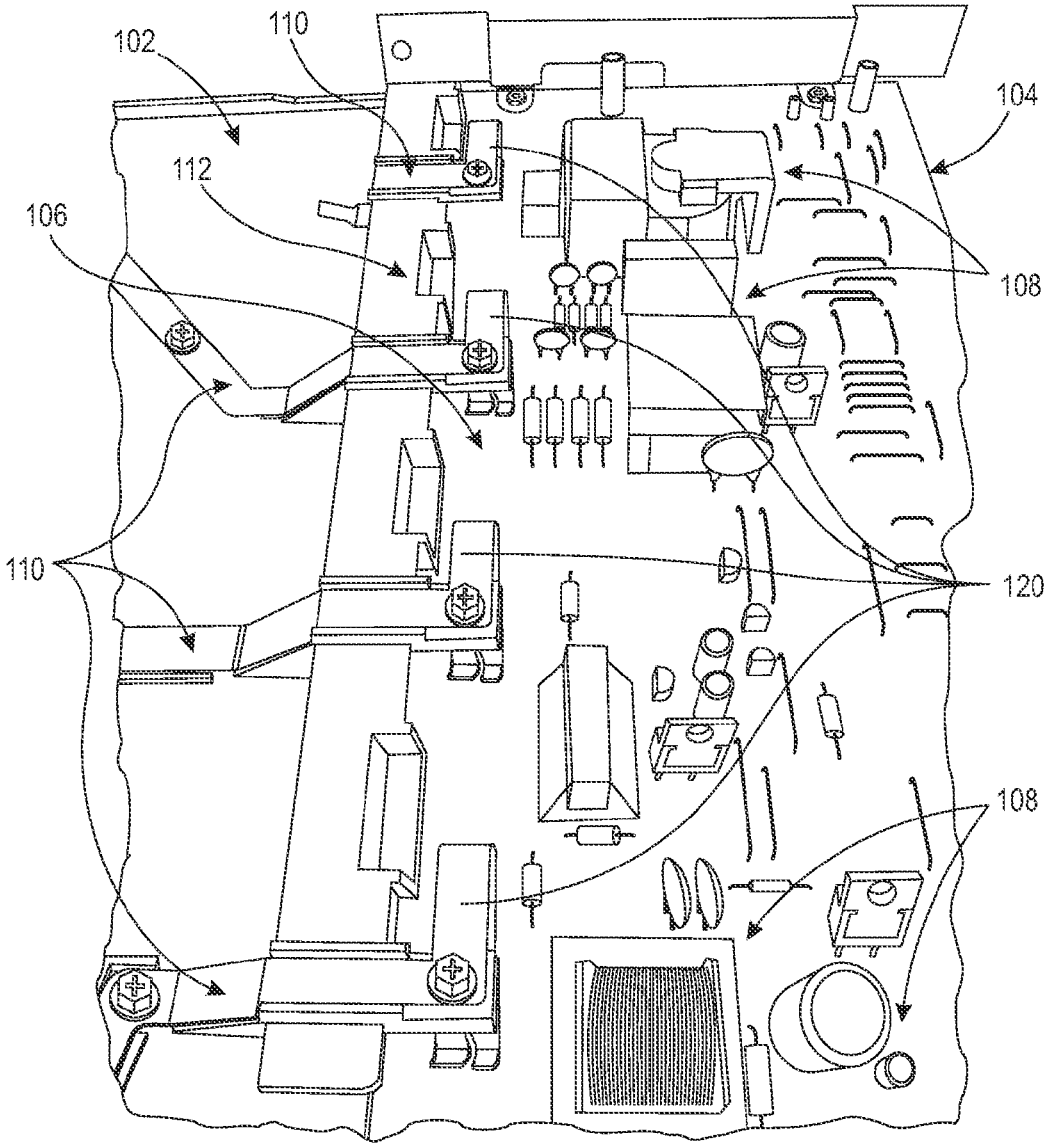
FIG. 7 is a photograph of a board positioned within a slot of a frame.

FIG. 7 is a photograph of the board 104 positioned within the slot 112 of the frame 102. As would be understood by those ordinarily skilled in the art, the board 104 is removable from the slot 112 (in this example, by being slid out of the slot 112 in the upward direction in the photograph of FIG. 7; however, those ordinarily skilled in the art would understand that many other removable board configurations could be utilized). As shown in FIG. 7, the contact ends 120 make contact with the power wires 106 on the board 104 when the board 104 is positioned within the slot 112, allowing the arms 110 to transmit the power generated by the various power generating components 108 on the board 104 to the various components of the devices (shown in FIGS. 8 and 9, discussed below).

Figure 8:
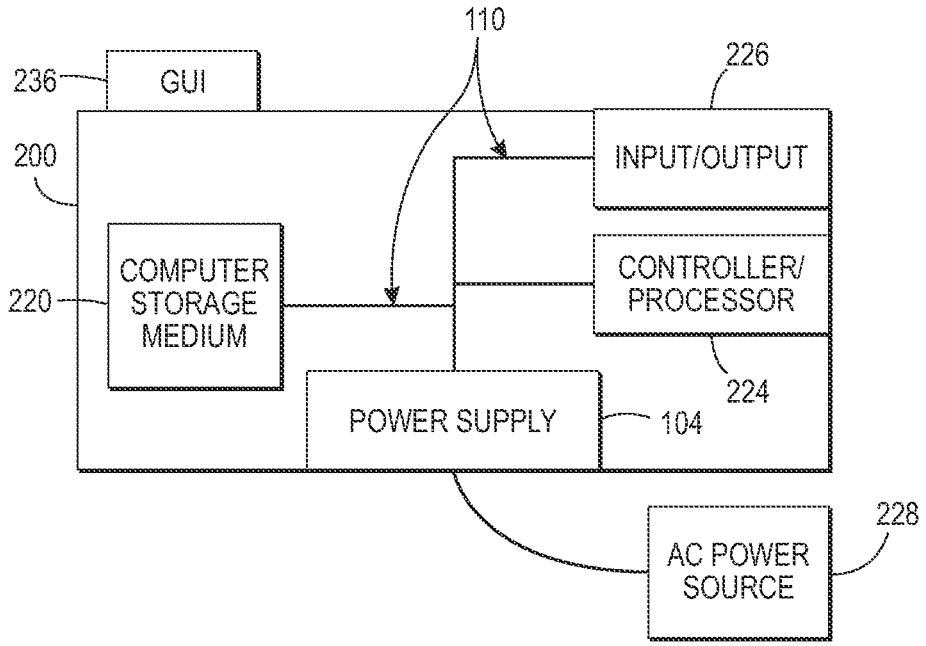
FIG. 8 is a schematic diagram illustrating computerized devices herein.

FIG. 8 illustrates a computerized device 200, which can be used with devices herein and can comprise, for example, a print server, a personal computer, a portable computing device, etc. The computerized device 200 includes a controller/tangible processor 224 and a communications port (input/output) 226 operatively connected to the tangible processor 224 and to the computerized network 202 external to the computerized device 200. Also, the computerized device 200 can include at least one accessory functional component, such as a graphic user interface assembly 236 that also operate on the power supplied from the external power source 228 (through the power supply board 104 and the conductive arms 110).

The input/output device 226 is used for communications to and from the computerized device 200. The tangible processor 224 controls the various actions of the computerized device. A non-transitory computer storage medium device 220 (which can be optical, magnetic, capacitor based, etc.) is readable by the tangible processor 224 and stores instructions that the tangible processor 224 executes to allow the computerized device to perform its various functions. Thus, as shown in FIG. 8, a body housing has one or more functional components that operate on power supplied from an alternating current (AC) source 228 converted to direct current (DC) by the power supply board 104 and transmitted to the various components by the conductive arms 110. The power supply board 104 can comprise a power storage element (e.g., a battery, etc).

Figure 9:
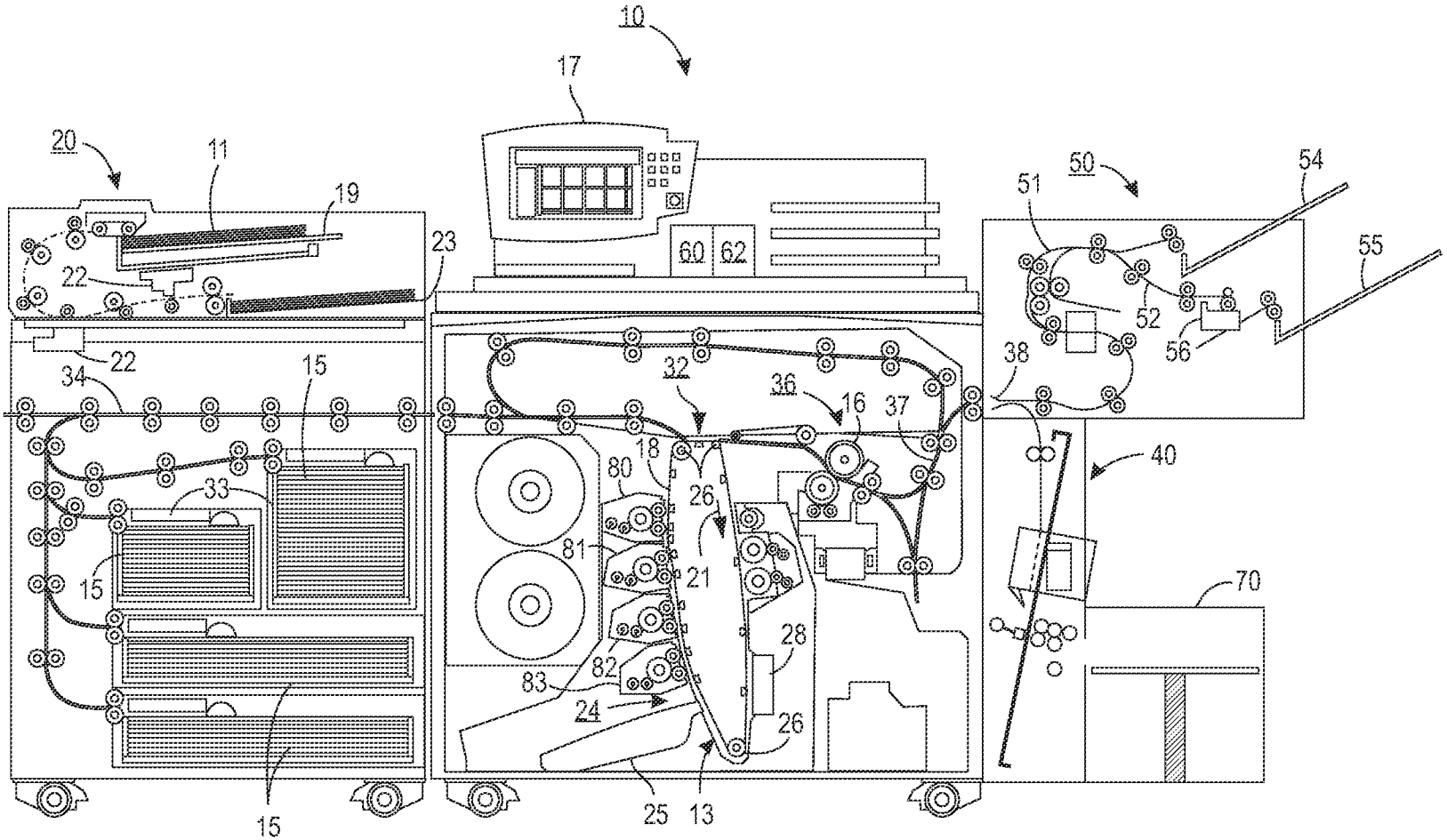
FIG. 9 is a schematic diagram illustrating devices herein.

Referring to the FIG. 9, a printing machine 10 that uses the power supply board 104 and conductive arm 110 arrangement shown above, can also include an automatic document feeder 20 (ADF) that can be used to scan (at a scanning station 22) original documents 11 fed from a tray 19 to a tray 23. The user may enter the desired printing and finishing instructions through the graphic user interface (GUI) or control panel 17, or use a job ticket, an electronic print job description from a remote source, etc. The control panel 17 can include one or more tangible processors 60, power supplies 62, as well as storage devices storing programs of instructions that are readable by the tangible processors 60 for performing the various functions described herein. The storage devices can comprise, for example, non-volatile tangible storage mediums including magnetic devices, optical devices, capacitor-based devices, etc.

An electronic or optical image or an image of an original document or set of documents to be reproduced may be projected or scanned onto a charged surface 13 or a photoreceptor belt 18 to form an electrostatic latent image. The belt photoreceptor 18 here is mounted on a set of rollers 26. At least one of the rollers is driven to move the photoreceptor in the direction indicated by arrow 21 past the various other known electrostatic processing stations including a charging station 28, imaging station 24 (for a raster scan laser system 25), developing stations 80-83, and transfer station 32. Note that devices herein can include a single development station 80, or can include multiple development stations 80-83. As would be understood by those ordinarily skilled in the art, item 18 could be an intermediate transfer belt; and, in such structures, the charging station 28, imaging station 24, etc., would be included within the image forming stations 80-83. In such structures, image forming stations 80-83 transfer patterned areas of marking material to the intermediate transfer belt 18. Therefore, FIG. 9 is intended to generally illustrate electrostatic printing structures, including structures that use a photoreceptor belt and structures that use an intermediate transfer belt.

Thus, the latent image is developed with developing material to form a toner image corresponding to the latent image. More specifically, a sheet 15 is fed from a selected paper tray supply 33 to a sheet transport 34 for travel to the transfer station 32. There, the toned image is electrostatically transferred to a final print media material 15, to which it may be permanently fixed by a fusing device 16. The sheet is stripped from the photoreceptor 18 and conveyed to a fusing station 36 having fusing device 16 where the toner image is fused to the sheet. A guide can be applied to the substrate 15 to lead it away from the fuser roll. After separating from the fuser roll, the substrate 15 is then transported by a sheet output transport 37 to output trays a multi-function finishing station 50.

Printed sheets 15 from the printer 10 can be accepted at an entry port 38 and directed to multiple paths and output trays 54, 55 for printed sheets, corresponding to different desired actions, such as stapling, hole-punching and C or Z-folding. The finisher 50 can also optionally include, for example, a modular booklet maker 40 although those ordinarily skilled in the art would understand that the finisher 50 could comprise any functional unit, and that the modular booklet maker 40 is merely shown as one example. The finished booklets are collected in a stacker 70. It is to be understood that various rollers and other devices, which contact end handle sheets within finisher module 50, are driven by various motors, solenoids and other electromechanical devices (not shown), under a control system, such as including the tangible processor 60 of the control panel 17 or elsewhere, in a manner generally familiar in the art.

Thus, the multi-functional finisher 50 has a top tray 54 and a main tray 55 and a folding and booklet making section 40 that adds stapled and unstapled booklet making, and single sheet C-fold and Z-fold capabilities. The top tray 54 is used as a purge destination, as well as, a destination for the simplest of jobs that require no finishing and no collated stacking. The main tray 55 can have, for example, a pair of pass-through sheet upside down staplers 56 and is used for most jobs that require stacking or stapling As would be understood by those ordinarily skilled in the art, the printing device 10 shown in FIG. 9 is only one example and the devices herein are equally applicable to other types of printing devices that may include fewer components or more components. For example, while a limited number of printing engines and paper paths are illustrated in FIG. 9, those ordinarily skilled in the art would understand that many more paper paths and additional printing engines could be included within any printing device used with devices herein.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the devices described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The devices herein can encompass devices that print in color, monochrome, or handle color or monochrome image data. All foregoing devices are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the devices herein cannot be implied or imported from any above example as limitations to any particular order, number, position, size, shape, angle, color, or material.

What is claimed is:

1. A power supply apparatus comprising:

an arm having a contact end, said contact end comprising a curved planar surface having a first edge and a second edge and terminating at an end edge, said first edge and said second edge extending along parallel curved lines within said curved planar surface and defining a width dimension of said contact end, said end edge following a straight line, and said contact end comprising a non-linear slot extending from said end edge along said curved planar surface positioned equally between said first edge and said second edge.

2. The apparatus according to claim 1, said non-linear slot having a regular waveform shape.

3. The apparatus according to claim 1, said non-linear slot having a zigzag shape comprising:

a first portion extending along a first line that is at a first angle that is other than parallel to said first edge and said second edge within said curved planar surface;

a second portion extending along a second line that is at a second angle that is other than parallel to said first edge and said second edge within said curved planar surface, and said first angle being complementary with said second angle relative to said first edge and said second edge within said curved planar surface.

4. The apparatus according to claim 1, said non-linear slot comprising a consistently dimensioned space centered between said first edge and said second edge.

5. The apparatus according to claim 1, said contact end comprising a voltage contact, said non-linear slot splitting said voltage contact into multiple voltage contacts.

6. The apparatus according to claim 1, said arm and said contact end comprising one of a metal and an alloy.

7. A power supply apparatus receiving a voltage from power rails on a circuit board, said power supply apparatus comprising:

a frame;

arms connected to said frame, each of said arms comprising a contact end, said frame positioning said contact end of each of said arms to contact said power rails of said circuit board, said contact end being biased towards said power rails to maintain said contact end in contact with said power rails, said contact end comprising a curved planar surface having a first edge and a second edge and terminating at an end edge, said first edge and said second edge extending along parallel curved lines within said curved planar surface and defining a width dimension of said contact end, said end edge following a straight line, and said contact end comprising a non-linear slot extending from said end edge along said curved planar surface positioned equally between said first edge and said second edge.

8. The apparatus according to claim 7, said non-linear slot having a regular waveform shape.

9. The apparatus according to claim 7, said non-linear slot having a zigzag shape comprising:

a first portion extending along a first line that is at a first angle that is other than parallel to said first edge and said second edge within said curved planar surface;

a second portion extending along a second line that is at a second angle that is other than parallel to said first edge and said second edge within said curved planar surface, and said first angle being complementary with said second angle relative to said first edge and said second edge within said curved planar surface.

10. The apparatus according to claim 7, said non-linear slot comprising a consistently dimensioned space centered between said first edge and said second edge.

11. The apparatus according to claim 7, said contact end comprising a voltage contact, said non-linear slot splitting said voltage contact into multiple voltage contacts.

12. The apparatus according to claim 7, said arm and said contact end comprising one of a metal and an alloy.

13. A power supply apparatus receiving a voltage from power rails on a circuit board, said power supply apparatus comprising:

a frame;

arms connected to said frame, each of said arms comprising a contact end, said frame comprising a slot positioning said contact end of each of said arms to contact said power rails of said circuit board, said circuit board being removable from said slot, said contact end being biased towards said power rails to maintain said contact end in contact with said power rails, said contact end comprising a curved planar surface having a first edge and a second edge and terminating at an end edge, said first edge and said second edge extending along parallel curved lines within said curved planar surface and defining a width dimension of said contact end, said end edge following a straight line, and said contact end comprising a non-linear slot extending from said end edge along said curved planar surface positioned equally between said first edge and said second edge.

14. The apparatus according to claim 13, said non-linear slot having a regular waveform shape.

15. The apparatus according to claim 13, said non-linear slot having a zigzag shape comprising:

a first portion extending along a first line that is at a first angle that is other than parallel to said first edge and said second edge within said curved planar surface;

a second portion extending along a second line that is at a second angle that is other than parallel to said first edge and said second edge within said curved planar surface, and said first angle being complementary with said second angle relative to said first edge and said second edge within said curved planar surface.

16. The apparatus according to claim 13, said non-linear slot comprising a consistently dimensioned space centered between said first edge and said second edge.

17. The apparatus according to claim 13, said contact end comprising a voltage contact, said non-linear slot splitting said voltage contact into multiple voltage contacts.

* * * * *